US005975809A

United States Patent [19]

Taylor et al.

[11] Patent Number: 5,975,809

[45] Date of Patent: Nov. 2, 1999

[54] APPARATUS AND METHOD FOR SECURING SOIL REINFORCING ELEMENTS TO EARTHEN RETAINING WALL COMPONENTS

[76] Inventors: Thomas P. Taylor, 2500 Cranberry La., Euless, Tex. 76039; William K. Hilfiker, 3718 Lakeridge Dr., Grapevine, Tex. 76051

[21] Appl. No.: 08/966,282

[22] Filed: Nov. 7, 1997

[51] Int. Cl.[6] ..... E02D 29/00; E02D 3/02

[52] U.S. Cl. ..... 405/262; 405/284; 405/286

[58] Field of Search ..... 405/262, 284, 405/286, 258, 272, 273

[56] References Cited

U.S. PATENT DOCUMENTS

| | | | |
|---|---|---|---|
| 4,324,508 | 4/1982 | Hilfiker et al. | 405/284 |
| 4,391,557 | 7/1983 | Hilfiker et al. | 405/287 |
| 4,470,728 | 9/1984 | Broadbent | 405/284 |
| 4,616,959 | 10/1986 | Hilfiker | 405/286 |
| 4,661,023 | 4/1987 | Hilfiker | 405/262 |
| 4,920,712 | 5/1990 | Dean | 52/169.4 |
| 4,929,125 | 5/1990 | Hilfiker | 405/262 |
| 5,066,169 | 11/1991 | Gavin et al. | 405/286 X |
| 5,139,369 | 8/1992 | Jaecklin | 405/262 |
| 5,257,880 | 11/1993 | Janopaul | 405/284 |
| 5,417,523 | 5/1995 | Scales | 405/284 |
| 5,484,235 | 1/1996 | Hilfiker | 405/284 |
| 5,533,839 | 7/1996 | Shimada | 405/284 |

FOREIGN PATENT DOCUMENTS

| | | | |
|---|---|---|---|
| 0 679 768 | 2/1995 | European Pat. Off. . | |
| 402183014 | 7/1990 | Japan | 405/262 |
| WO 94/13890 | 6/1994 | WIPO . | |

OTHER PUBLICATIONS

Sweet's Engineering and Retrofit: Mechanical, Civil/Structural 1993 Catalog File, published by McGraw–Hill (1993), Section 02276/ (KEY, ROC and AND) (*Earth Retainage, Buylines 2802* (*Keystone*), 6342 (*Rockwood*), and 7682 (*Diamond*).

*Primary Examiner*—Dennis L. Taylor
*Attorney, Agent, or Firm*—Limbach & Limbach, L.L.P.

[57] ABSTRACT

A soil reinforced structure comprised of superimposed courses of concrete blocks, at least some of which have rearward portions separable therefrom. Longitudinally extending soil reinforcing members extend around the separable rearward portions and are captured between the courses of blocks thereabove and therebelow. In one embodiment the blocks have bifurcated forward portions about which a cast in place concrete face may be formed. Another embodiment disposes courses of the blocks in opposed spaced relationship and extends the soil reinforcing members between the blocks to form a earthen fortress.

18 Claims, 7 Drawing Sheets

APPARATUS AND METHOD FOR SECURING SOIL REINFORCING ELEMENTS TO EARTHEN RETAINING WALL COMPONENTS

FIELD OF THE INVENTION

The present invention relates to a new and improved connection for attaching soil reinforcing elements to segmental concrete members forming the face of a retaining wall for an earthen formation. In its more particular aspects, the invention is concerned with an attaching technique where the soil reinforcing elements are wrapped around transversely extending blocks and the blocks are then captured between blocks forming part of the face panel. The invention is especially concerned with an improved connection which transmits forces directly to the longitudinally extending tension members of a soil reinforcing element.

BACKGROUND OF THE INVENTION

The customary way of attaching steel soil reinforcing elements to the face panels for an earthen formation is by using bolts, pins or other specially shaped anchors. Geotextile reinforcing elements are typically attached to face panels by using special combs or plastic pins. All of these expedients generally rely upon connection to and the integrity of the transversely extending elements of the soil reinforcing member.

Prior systems which rely upon placing the soil reinforcing member over the tops of pins are necessarily of limited strength. Because of this, the transmission of loads to the face panels is limited. In most prior art, pin type connections, little or no strength is derived from the elongate tension members of the soil reinforcing elements; the strongest members in the elements.

Prior connections which rely upon specially shaped loop, comb or clip elements typically have the elements cast directly into the face components and require special constructions that have high material and manufacturing costs. The prior art also teaches wrapping steel or geotextile soil reinforcing members around rods and then capturing these rods between specially formed face panels for an earthen formation. Such constructions may be seen in U.S. Pat. Nos. 4,324,508 and 4,616,959 by William K. Hilfiker, one of the co-inventors herein.

SUMMARY OF THE INVENTION

The present invention provides an apparatus and method for securing the longitudinal tension members of a soil reinforcing mat to the face panels for a retained earthen formation by wrapping the members around a securing block so disposed that the members are held between the block and the face panels. In its more specific aspects, the invention is concerned with such an arrangement wherein the tension members are held in multiple planes and the blocks are cast concrete so configured that they may be manufactured by standard block manufacturing techniques. Certain embodiments provide block configurations for the face panels which have a bifurcated open face about which a cast in place surface may be formed. The face panel and securing blocks may be assembled into a configuration which provides spaced walls with the tension members of the soil reinforcing elements secured therebetween to form a fortress pier.

A principal object of the invention is to provide a structure for connecting soil reinforcing elements to the face panels of a retained earthen formation which relies on the strongest members of the soil reinforcing elements to provide the integrity of the connection.

Another object of the invention is to provide a connection between a soil reinforcing mat and the concrete block elements of a face panel for an earthen formation which relies on pressure that develops at the interface between the concrete elements to secure the soil reinforcing mat to the face panel.

A related object of the invention is to provide a connection for securing soil reinforcing mats to the face panels which is not dependent upon the integrity of the transversely extending elements of the mats.

Still another object of the invention is to provide a connection which may be achieved through the employment of blocks which form both the face panels and the securing means and serve to hold the soil reinforcing elements to the face panels.

A further object is to provide a connection where the securing means may comprise polymer plastic or metallic angle or box elements which are held to the face panel blocks with the tension members of the soil reinforcing elements captured in place in multiple planes.

Yet another object is to provide a connection where the soil reinforcing mat is placed and secured in more than one plane.

Another object related to the latter object is to provide such a connection where the soil reinforcing mat is sandwiched between blocks forming the face panel and held in place by frictional pressure in three planes.

Yet a further object is to provide a face panel and connection which uses block shapes that can be manufactured in block plants through the use of conventional equipment.

Another object of the invention is to provide a block construction for the face panel of a soil reinforced retaining wall which provides for both the connection of soil reinforcing mats to the panel and the formation of a cast in place surface on the panel.

Yet another object is to provide a block and connection which may be assembled into a fortress structure comprised of spaced walls having soil reinforcing mats extending therebetween.

Another more specific object is to provide face panels and securing block elements so configured as to interengage and resist relative separation.

These and other objects will become more apparent when viewed in light of the following description and accompanying drawings.

DETAILED DESCRIPTION OF THE PREFERRED EMBODIMENTS

Figure 3:
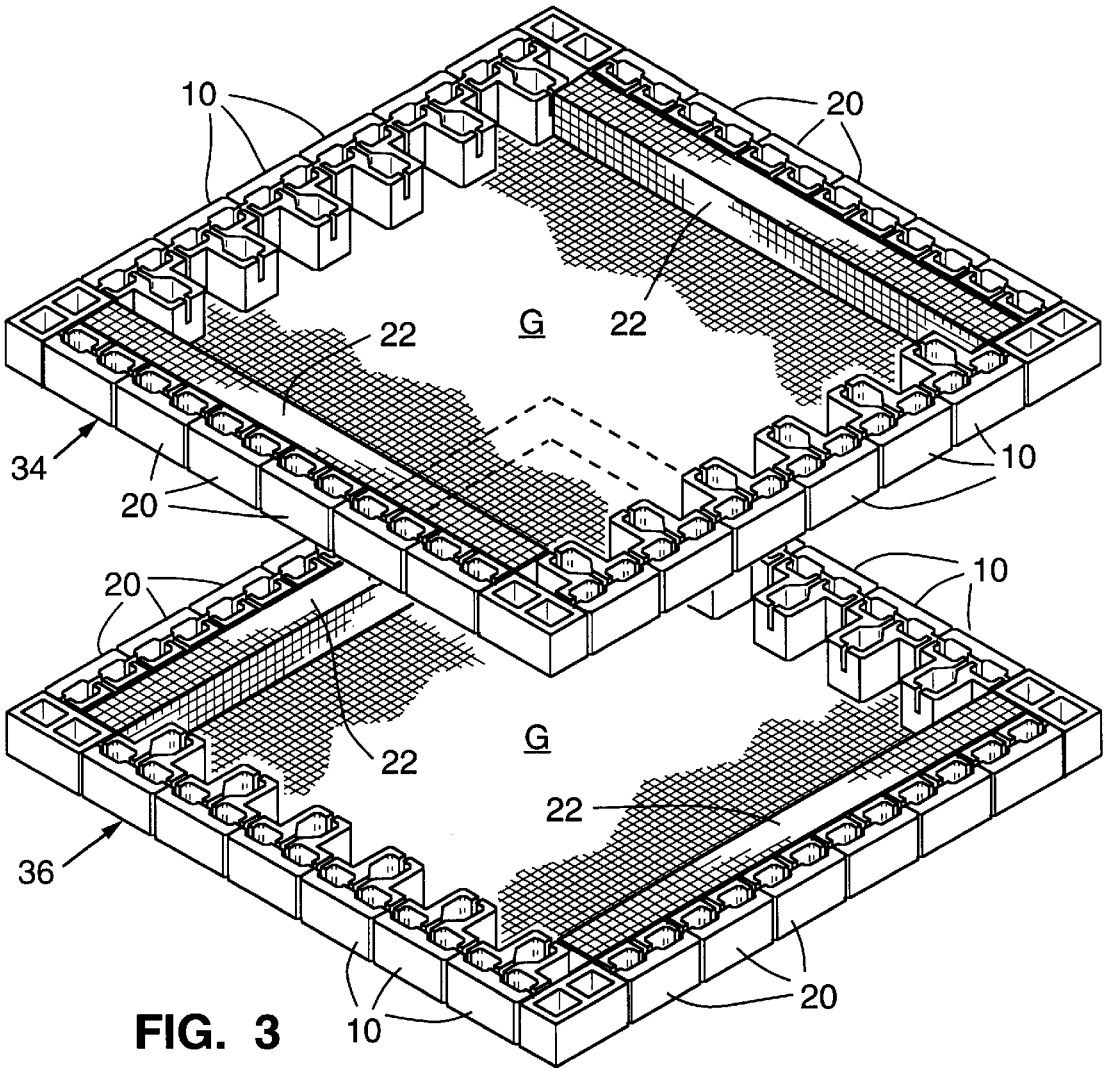
FIG. 3 is an exploded perspective view illustrating a fortress structure constructed of multiple layers of opposed block walls comprised of block components constructed according to the first embodiment, with each layer being oriented so as to be turned 90 degrees relative to the layers adjacent thereto.
Figure 4:
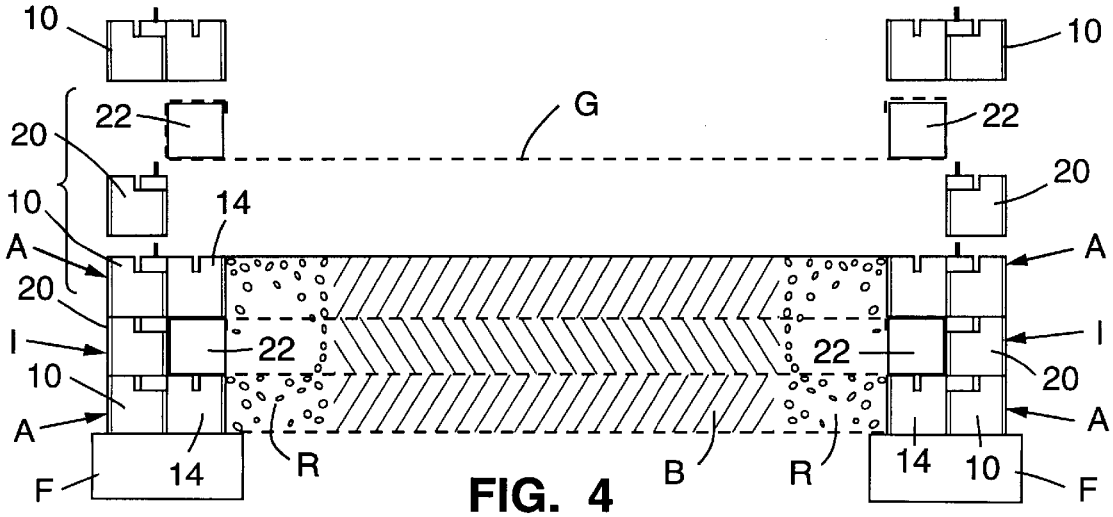
FIG. 4 is a cross-sectional elevational view of the FIG. 3 fortress, with the lower portion illustrating an assembled portion of the fortress and the upper portion showing the components exploded to illustrate the manner in which they are assembled.

The various embodiments of the invention will now be described in detail. While each embodiment will be separately described and the fortress shown in FIGS. 3 and 4 will be described with respect to the first embodiment, it should be understood that the features of the various embodiments may be combined and that the structures formed through utilization of the embodiments may be altered from those illustrated. For example, although the fortress of FIGS. 3 and 4 is shown as being constructed with the components of the first embodiment, it could be constructed in whole or in part with the components of the other embodiments.

First Embodiment

(FIGS. 1, 1*a* 3 and 4)

Figure 1:
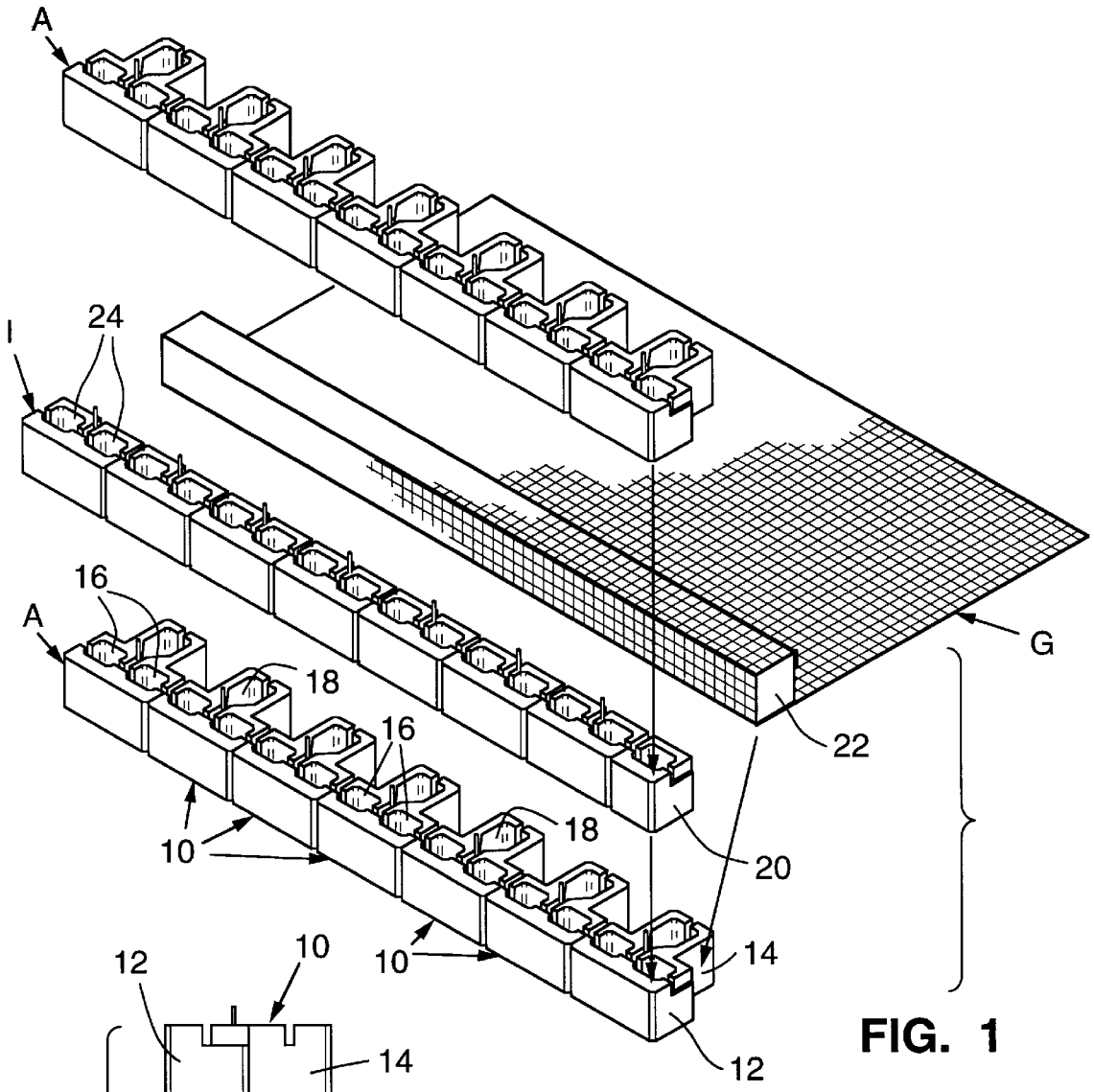
FIG. 1 is an exploded perspective view illustrating the face panel and securing block components of a first embodiment of the invention, with a soil reinforcing mat wrapped around the securing block component.
Figure 2:
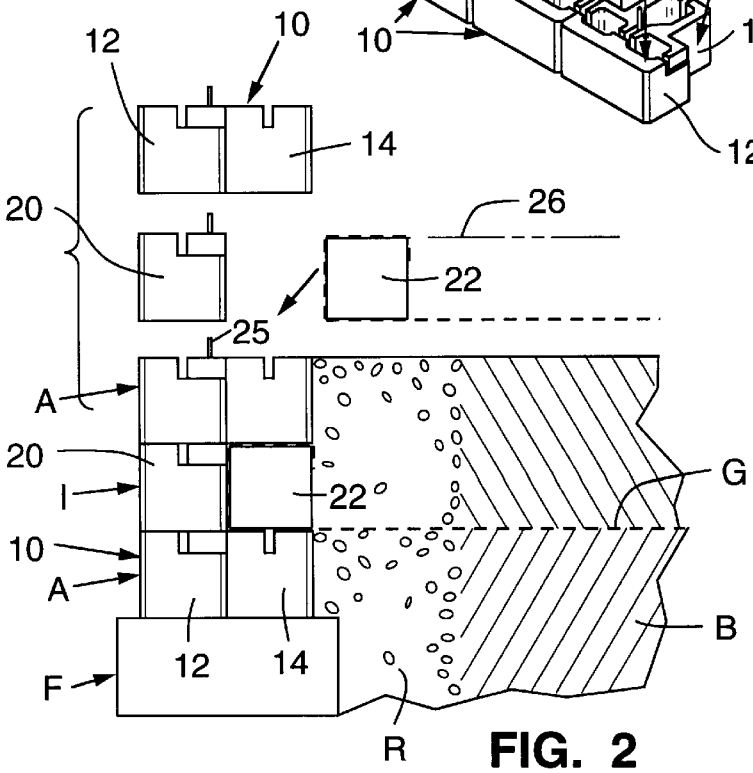
FIG. 2 is a cross-sectional elevational view of the first embodiment, with the lower portion illustrating an assembled soil reinforced wall and the upper portion showing the components exploded to illustrate the manner in which they are assembled.

Referring now to FIGS. 1 and 2, alternate and intermediate courses of blocks are designated by the letters A and I, respectively. The blocks are fabricated of concrete and configured for mass production in a typical concrete block plant. The blocks of the alternate courses are designated by the numeral 10 and are of generally the same open celled T-shaped configuration as those of our U.S. Pat. No. 5,484,235. Each block 10 comprises integrally formed front and rear portions 12 and 14, respectively. The front portions have two open cells 16 extending vertically therethrough. The rear portions have an open cell 18 extending vertically therethrough. In a typical embodiment, the blocks 10 have a height of 8 inches, a width of 16 inches and a depth of 16 inches. The depth is divided approximately equally between the front and rear portions 12, 14.

The intermediate courses I are disposed between the alternate courses and comprised of front block portions 20 and rear block portions 22 separable from the front block portions. The front block portions 20 are of an open celled configuration and measure 16 inches in width, 8 inches in height and 8 inches in depth. The open cells extending vertically through the front block portions are designated 24. The rear block portions 22 are concrete masonry units having a cross-section of approximately 7⅝ inches by 7⅝ inches and a length of between 18 and 54 inches. Where the face panel of the wall is of a relatively narrow width, the rear block portion may have a length equal to the composite length of the front block portions.

FIG. 2 shows the first embodiment blocks assembled into the face panel for a soil reinforced earthen formation, with the rear block portions 22 of the intermediate courses having a geotextile soil reinforcing gridwork G wrapped therearound. As there shown, a foundation footing F is disposed at the foot of the face of the formation being retained. A first course of alternate blocks 10 is supported directly on the footing F and drain rock R and backfill soil B is filled in behind the first course to its upper level. The next intermediate course of blocks 20 is then laid over the first alternate course so that the front block portions 20 of the intermediate course rests upon the front portions 12 of the alternate course. Pins 25 extend into openings formed in the blocks 10 and the front block portions 20 to maintain these components in alignment.

With the blocks 10 of the first alternate course and the front block portions 20 of the next intermediate course so positioned, the back surfaces of the front block portions 20 provide a rearwardly facing surface and the top surfaces of the rear portions 14 provide a shoulder extending from this surface. A geotextile gridwork is then wrapped around the rear block portion 22 as seen in FIG. 1 so that the longitudinally extending elements of the gridwork extend generally normal to the rear block portions 22. The rear block portions 22, with the gridwork G wrapped therearound, are then placed upon the shoulder provided by the rear portion of the first alternate course of blocks and the gridwork is extended over the drain rock R and backfill soil B which has been filled in behind the first alternate course of blocks. Next a second alternate course of blocks 10 is positioned over the first intermediate course of blocks, as shown in FIG. 2. Drain rock R and backfill soil B is then filled in behind this second course, as seen in FIG. 2. The process of repeatedly placing alternate courses and intermediate courses, together with the placement of the geotextile gridworks and the backfilling of drain rock and soil is repeated course after course until the wall has been erected to the desired height.

From the lower portion of FIG. 2, it will be seen that the geotextile gridwork G extends around three sides of the rear block portion 22 and is clamped between these sides and the surfaces of the blocks to the bottom, front and top of the block portions 22. This clamping action functions to secure the gridwork to the blocks of the face panel. Tension applied to the geogrid as the result of loading of the face panel is transmitted directly to the longitudinally extending elements of the geogrid. Where additional anchoring is desired, the geogrid may be extended from the top surface of the block 22 back into the earthen formation, as depicted by the phantom line 26 in FIG. 2.

Figure 1A:
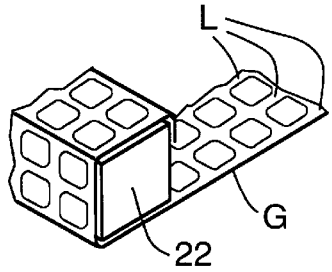
FIG. 1*a* is an enlarged perspective view illustrating the manner in which a geotextile gridwork soil reinforcing mat is extended around the securing block of the first embodiment.

The manner in which the gridwork G extends around the rear block portion 22 may best be seen from FIG. 1*a*. As there shown, it will be seen that the longitudinal elements of the gridwork, designated L, extend around the block portion 22 in generally normal relationship thereto. The aforedescribed clamping force is applied directly to these longitudinal elements. As a result, the connection between the gridwork and the securing block provided by the rear block portion 22 is not dependent upon the integrity of the transversely extending elements of the gridwork, as is customary with pin or comb-type connections.

FIGS. 3 and 4 show a fortress pier constructed through utilization of the first embodiment blocks. As there shown, it will be seen that the blocks are assembled in layers, with each layer comprising opposed alternate courses of blocks disposed in spaced relationship to one another and opposed intermediate courses of blocks in disposed spaced relationship to one another and normal to the alternate course blocks of the layer. Geogrids are secured to and extend between the opposed intermediate courses of each layer. The layers are designated 34 and 36 and are aligned, with each successive layer being oriented at 90 degrees relative to the next layer. As the result of this 90 degree relationship, the gridworks of successive layers extend at 90 degrees relative to one another. This results in a fortress where the outside walls are secured against separation from one another in all directions.

The process of erecting the fortress corresponds to that used for the wall of FIG. 2, except that it is being carried out on four sides at a time (i.e. each layer comprises four sides, two of which are opposed alternate courses and two of which are opposed intermediate courses, with the alternate and intermediate courses within each layer being disposed at 90 degrees relative to one another. The 90 degree relationship may best be appreciated from the exploded perspective view of FIG. 3.)

Figure 5:
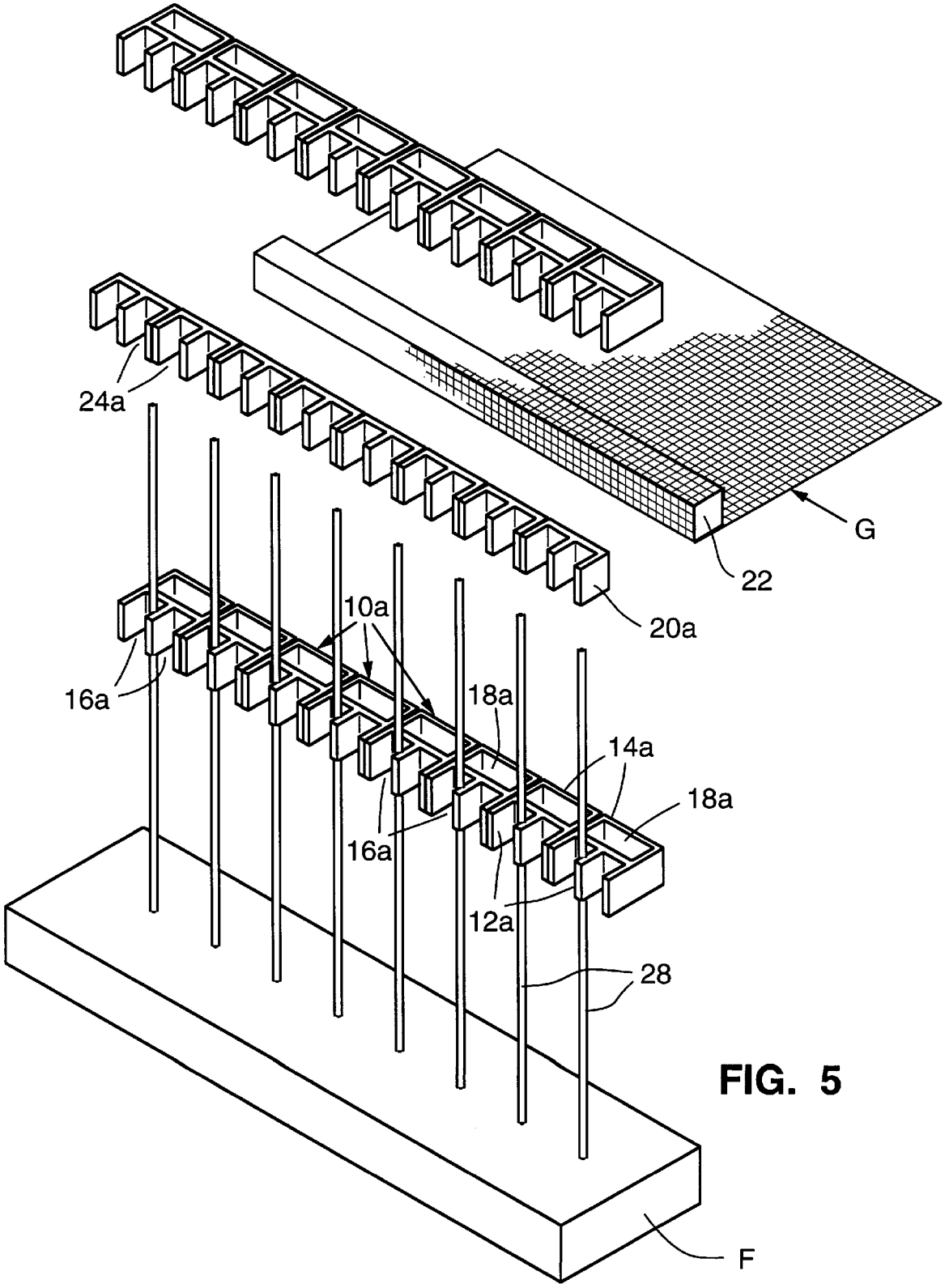
FIG. 5 is an exploded perspective view illustrating the face panel and securing block components of a second embodiment of the invention wherein the face panel components are configured for having a cast in place face formed thereover, showing a foundation footer at the bottom of the face panel components and a soil reinforcing mat wrapped around the securing block component.
Figure 6:
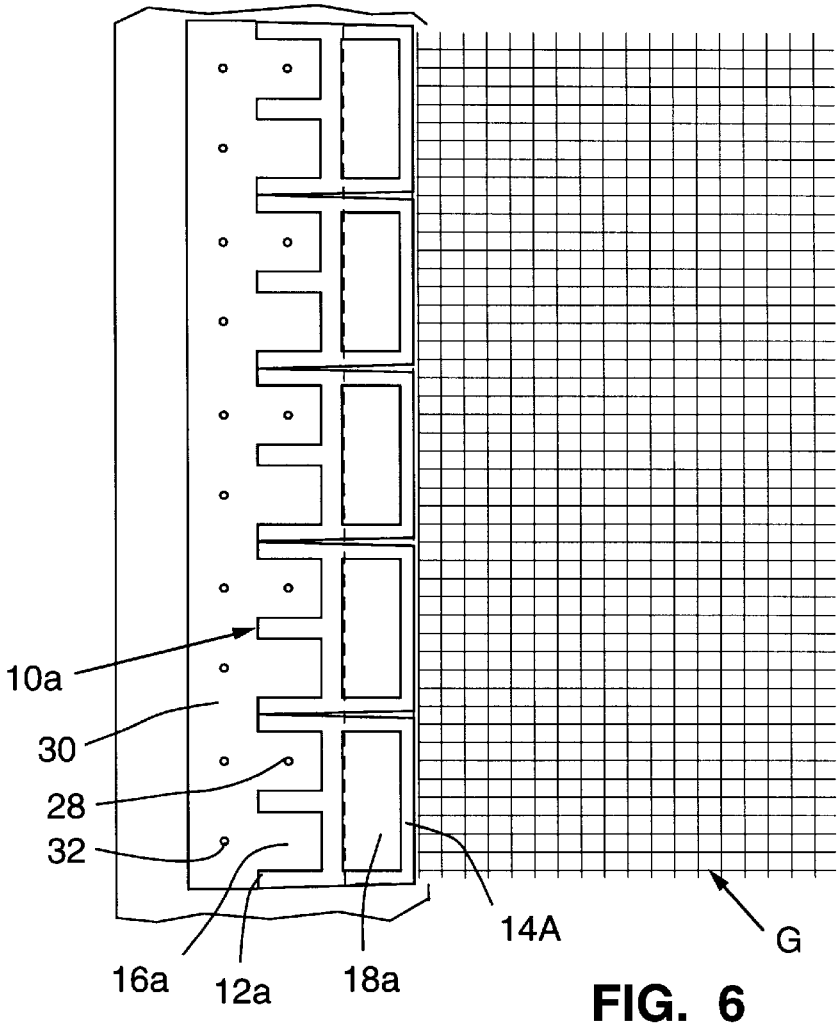
FIG. 6 is a top plan view, with parts thereof broken away, illustrating an assembled soil reinforced wall constructed according to the second embodiment.
Figure 7:
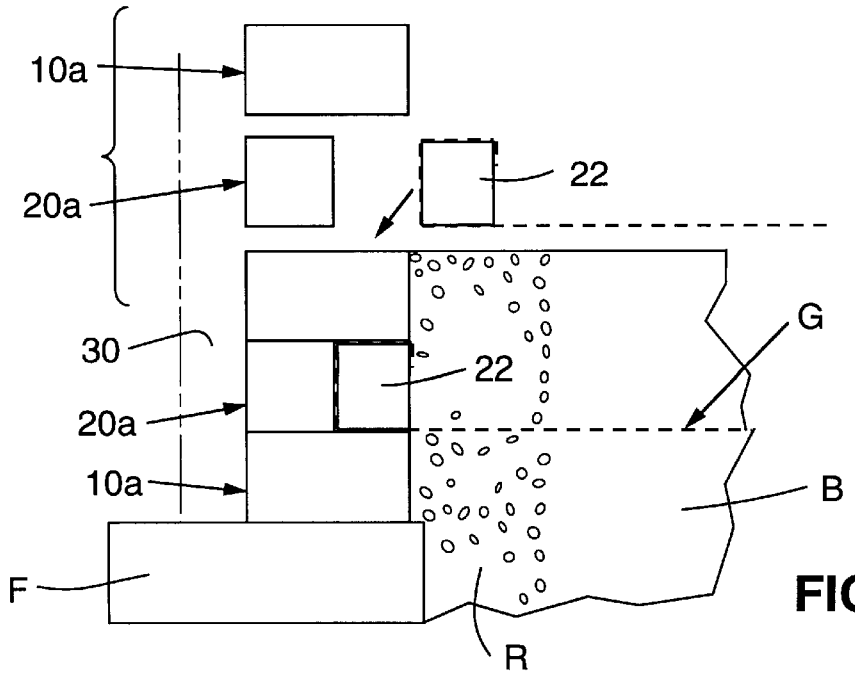
FIG. 7 is a cross-sectional elevational view of the second embodiment, with the lower portion illustrating an assembled soil reinforced wall and the upper portion showing the components exploded to illustrate the manner in which they are assembled.

Second Embodiment (FIGS. 5, 6 and 7)

The second embodiment differs from the first embodiment primarily in that the front portions of the alternate course blocks and the front block portions of the intermediate course blocks are of an open faced bifurcated configuration to facilitate the formation of a cast-in-place face on the wall. Another difference is that the alternate course blocks are of a uniform width, rather than a T-shape. The latter difference somewhat increases the clamping action between these rear portions and the rear block portions of the intermediate courses of blocks. Components of the second embodiment which are identical to those of the first embodiment are designated by like numerals. Components which correspond, but have a different structure, are designated by like numerals, followed by the letter a, as follows:

| | |
|---|---|
| Alternate Course Blocks | 10a |
| Front Portions | 12a |
| Rear Portions | 14a |
| Open Cells | 18a |
| Front Block Portions | 20a |

In place of the open cells 16 and 24 of the first embodiment, the second embodiment blocks are formed with open faced bifurcated cells 16*a* and 24*a*. Another difference between the first and second embodiments is that rebars 28 are cast within and extend upwardly from the foundation footing F of the second embodiment. These rebars are positioned so as to align with and extend through the open faced bifurcated cells 16*a* and 24*a* of the assembled face panel.

The face panel and soil reinforcing geotextile gridwords of the second embodiment are erected on the foundation footing F in the same manner as the first embodiment. This may be seen from FIGS. 5 and 7. When so assembled, the gridworks G are wrapped around the rear block portions 22 and captured between the surfaces of the block portions to three sides thereof. The clamping action is actually greater than that of the first embodiment as the result of fabricating the rear portions 14*a* to the full width of the alternate course blocks 10, rather than fabricating them as T-sections.

The face panel of the second embodiment is completed by forming a concrete face 30 in place within and to the front of the bifurcated open cells 16*a* and 24*a*. This construction can most clearly seen from FIG. 6. As there illustrated, it will be seen that the rebars 28 extend through the face. Additional rebars 32 are shown cast-in-place to the front of the bifurcated open cells. FIG. 7 shows a phantom line depicting the outside surface of the cast-in-pace face 30.

Figure 8:
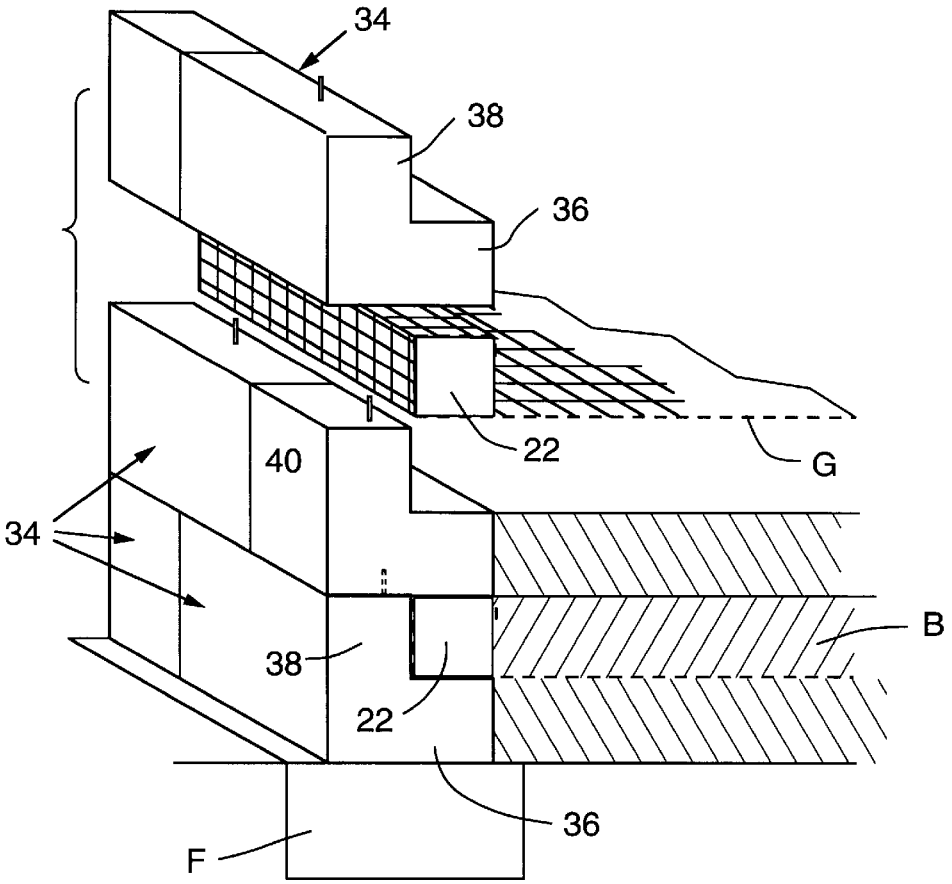
FIG. 8 is a perspective view illustrating a soil reinforced retaining wall constructed according to a third embodiment of the invention, with the lower portion showing the assembled wall supported on a foundation footer and the upper portion showing the face panel and securing block components exploded to illustrate the manner in which they are assembled.

Third Embodiment (FIG. 8)

The third embodiment differs from the first embodiment in that it employs integral L-shaped blocks 34 which vertically span the outside of the alternate and intermediate courses. Each L-shaped block 34 includes a lower leg portion 36 which has the same function as the alternate course blocks 10 of the first embodiment and an upper leg portion 38 which has the same function as the front block portion 20 of the first embodiment.

The earthen retaining wall and face panel of the second embodiment is erected in the same manner as that of the first embodiment. The only difference is that the upper leg portion 38 avoids the need of separately assembling front block portion 20 into place. First the alternate courses are laid through placement of the lower leg portions of the blocks 34 on the foundation F. Next the intermediate courses are laid by positioning the rear block portions 22, with the geotextile gridwork extending therearound, on the ledge provided by the lower leg portion 36. This process of laying the alternate and intermediate courses is repeated until the wall reaches the desired height.

As shown in FIG. 8, the blocks 36 are not open celled and are provided with pins 40 received in aligned holes to maintain the blocks in aligned condition when assembled into the face panel for an earthen retaining wall. The third embodiment also differs from that of the first embodiment in that it is not provided with drain rock behind the face panel. Such rock may or may not be used, depending upon the soil condition.

Figure 9:
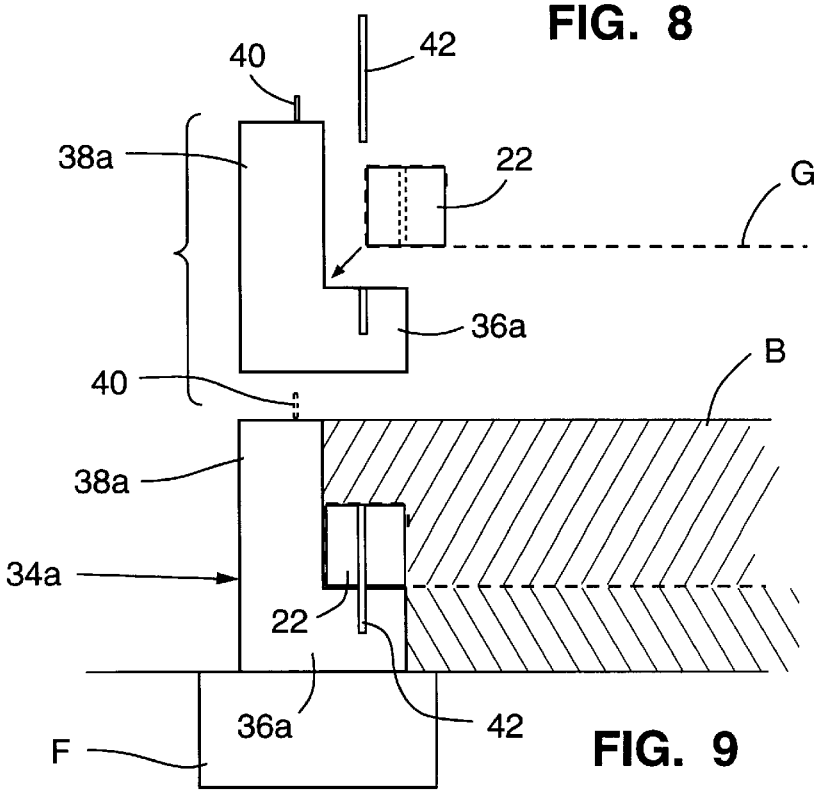
FIG. 9 is a cross-sectional elevational view illustrating a soil reinforced retaining wall constructed according to a fourth embodiment of the invention, with the lower portion showing the assembled wall supported on a foundation footer and the upper portion showing the face panel and securing block components exploded to illustrate the manner in which they are assembled.

Fourth Embodiment (FIG. 9)

This embodiment differs from the third embodiment in structure in that it employs L-shaped blocks 34*a* having an upper leg portion 38*a* of a height greater than that of the rear block portion 22. As a result, when a face panel is assembled according to the fourth embodiment, the rear block portion 22 is spaced from the lower leg portion, designated 36*a*, of the block 34*a* thereabove. This means that the portion of the geotextile gridwork G extending over the block 22*a* in the fourth embodiment is not frictionally engaged by the block thereabove. Rather, it is held down by the earthen backfill B thereabove. Pins 42 extend through aligned openings in the rear block portions 22 and the leg 36*a* to assist in maintaining the rear block portions from displacement from the shoulder provided by the lower leg portion 36*a*. The fourth embodiment also employs pins 40 corresponding to those of the third embodiment to maintain the L-shaped blocks in stacked alignment.

The process of assembling the wall of the fourth embodiment corresponds to that of the third embodiment, except for the additional placement of the pins 42 and for the placement of backfill soil over the rear block portions 22.

Figure 10:
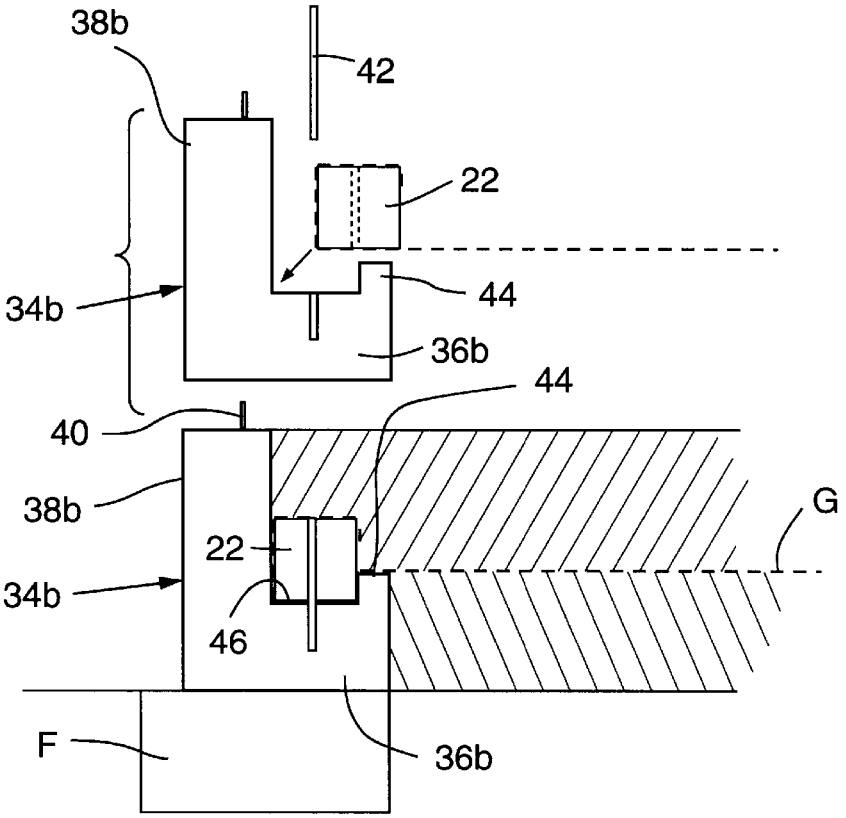
FIG. 10 is a cross-sectional elevational view illustrating a soil reinforced retaining wall constructed according to a fifth embodiment of the invention, with the lower portion showing the assembled wall supported on a foundation footer and the upper portion showing the face panel and securing block components exploded to illustrate the manner in which they are assembled.

Fifth Embodiment (FIG. 10)

This embodiment is similar to the fourth embodiment in that it employs L-shaped legs 34B having upper leg portions 38B of a height greater than the depth of the rear block portions 22. It differs from the fourth embodiment, however, in that the lower leg portions 36B of the L-shaped blocks are formed with a turned up distal edge 44 spaced from the inside surface of the upper leg portion 38B to form a channel 46 proportioned for complimental receipt of the rear block portions 22. As a result of this difference, the rear block portions 22 are securely held in place when the fifth embodiment face panel is assembled, as can be seen from the lower part of FIG. 10. The turned up distal edge 44 also functions to put an additional bend in the gridwork G when the panel is assembled into place. This additional bend results because the gridwork must extend up and over the turned up distal edge 44.

The steps for assembling a panel with the fifth embodiment correspond to those of the fourth embodiment. Like the fourth embodiment, the rear block portions 22 are held down by backfill soil B and does not engage the block thereabove.

Figure 11:
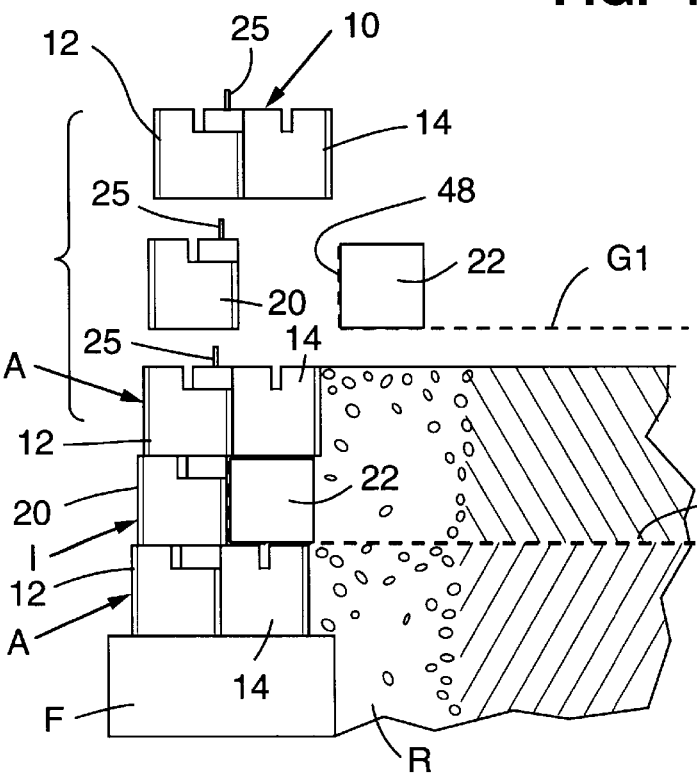
FIG. 11 is a cross-sectional elevational view illustrating a soil reinforced retaining wall constructed according to a sixth embodiment of the invention, with the lower portion showing the assembled wall supported on a foundation footer and the upper portion showing the face panel and securing block components exploded to illustrate the manner in which they are assembled.
Figure 11A:
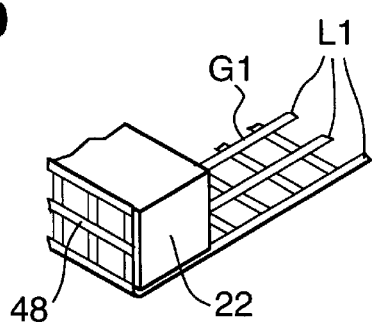
FIG. 11*a* is an enlarged perspective view showing the manner in which the welded wire gridwork of the sixth embodiment wraps around the securing block component.

Sixth Embodiment (FIGS. 11 and 11*a*)

This embodiment corresponds to the first embodiment, except that the successive courses of blocks are stacked in slightly stepped relationship so as to provide a face which slopes backwardly toward the formation being constrained and the soil reinforcing gridwork is welded wire, rather than a geotextile. The welded wire gridwork of the eleventh embodiment is designated G1 and its longitudinal members are designated L1. All other components of this embodiment correspond to those of the first embodiment and are designated by like letters and numbers.

Prior to assembling the face panel and soil reinforced wall of the sixth embodiment, the welded wire gridwork G1 is bent at a right angle to form a turned up end 48 having a height approximately equal to that of the rear block portions 22. With the welded wire mat so prepared, the face panel and wall is assembled in the same manner as the first embodiment wall, except that the welded wire mats are not extended over the top of the rear block portions 22. Accordingly, the welded wire mats are clamped only between the rear block portion 22 and the surfaces to the bottom and to the front of that portion. Thus the mat is clamped in only two planes, namely the vertical plane defined between the front block portion 20 and the rear block portion 22 and the horizontal plane defined between the rear portion 14 and the rear block portion 22. Like the geotextile embodiment, however, the connection of the gridwork to the rear block portion is through the longitudinal wires L1 of the gridwork and is not dependent upon the integrity of its transverse wires. This may be seen from the exploded view of FIG. 11*a*.

The pins 25 of the sixth embodiment extend into aligned openings in the front block components. These openings are so set as to establish the desired stepped alignment of the front block components.

Figure 12:
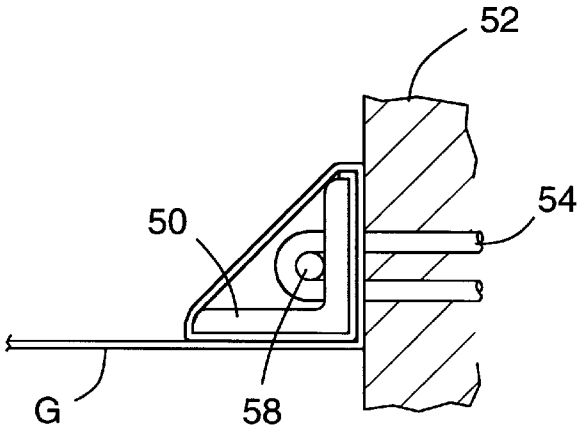
FIG. 12 is a cross-sectional elevational view illustrating the connection between the face panel and securing components of a seventh embodiment of the invention, with a soil reinforcing mat wrapped around the securing component.
Figure 12A:
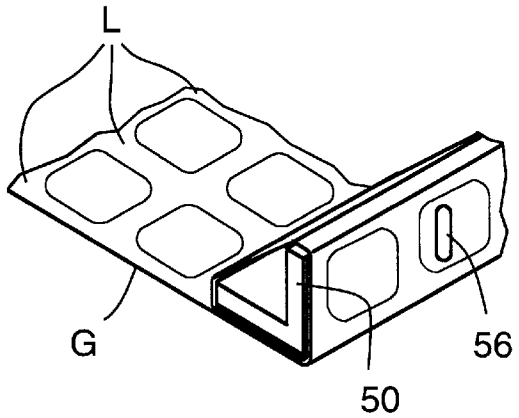
FIG. 12*a* is an enlarged perspective view of the angle-shaped securing component of the seventh embodiment.

Seventh Embodiment (FIGS. 12 and 12*a*)

The seventh embodiment does not rely upon capturing of the soil reinforcing gridwork between block components. Rather, it secures the gridwork by means of wrapping the gridwork about an elongate angle 50 and then clamping the angle to the back of a face panel 52 through means of a U-shaped anchor 54 embedded in the panel 52 which extends through a slot 56 in one leg of the angle and is held to the angle by a securing rod 58. The rod 58 extends through the closed end of the U-shaped anchor and over the slotted leg of the angle.

In assembling the connection of the seventh embodiment, the gridwork G is first wrapped around the angle 50 as shown in FIG. 12 and then the angle, with the gridwork therearound, is threaded over the U-shaped anchor and against the face of the panel. The rod 58 is then passed through the U-shaped anchor and over the slotted leg of the angle. While only one slot and U-shaped anchor 54 is illustrated, it should be understood that a plurality of such anchors and slots would be provided, the number depending upon the length of the angle. The resulting connection clamps the gridwork to the back of the panel 52 and transmits tension forces from the gridwork to the panel through the longitudinal elements of the gridwork, without dependency upon the integrity of the transverse elements of the gridwork.

Figure 13:
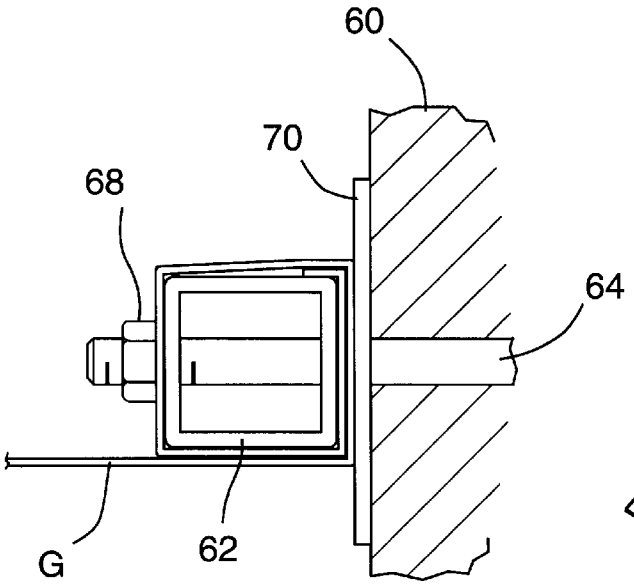
FIG. 13 is a cross-sectional elevational view illustrating the connection between the face panel and securing component of an eighth embodiment of the invention, with a soil reinforcing mat wrapped around the securing component; and, FIG. 13*a* is an enlarged perspective view of the box-shaped securing component of the eighth embodiment.
Figure 13A:
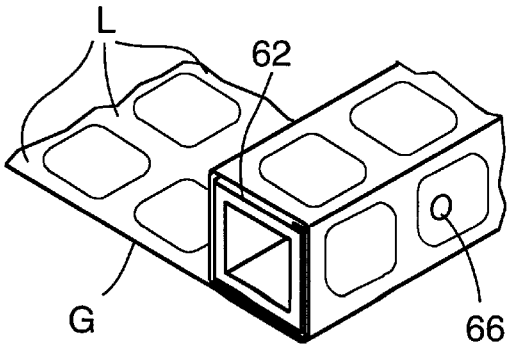

Eighth Embodiment (FIGS. 13 and 13*a*)

This embodiment achieves connection of a geotextile gridwork G to a face panel 60 by wrapping the gridwork around an elongate rectangular securing member 62 and then fastening the securing member to the face panel 60 through means of an anchor bolt 64 which is fixedly embedded into the panel and extended through aligned openings 66 in the securing member. A nut 68 is threadably received on the distal end of the bolt 64 to hold the member 62 to the panel 60. As shown, a plate 70 is interposed between the rectangular securing member and the face panel 60 to provide a surface against which the geotextile gridwork wrapped around the member 62 may be clamped.

The gridwork G wraps fully around the rectangular securing member 62 with the longitudinal elements of the gridwork extending generally normal to the rectangular member. As a result of this interrelationship and the clamping of the rectangular member to the face panel, tension forces applied to the gridwork are transmitted to the face panel through the longitudinal members of the gridwork, without dependency upon the integrity of the transversely extending members of the gridwork.

Conclusion

While preferred embodiments have been illustrated and described, it should be understood that the invention is not intended to be limited to the specifics of these embodiments, but rather is defined by the accompanying claims.

We claim as our invention:

1. An improved apparatus for securing a soil reinforcing mat having a longitudinal tension member to a face panel for an earthen formation, said apparatus comprising:

(a) an upwardly facing shoulder extending from a rearwardly facing surface of the face panel, said shoulder having a support surface;

(b) a securing block separate from and extending transversely of the face panel, said block being supported on the shoulder and having surfaces disposed in apposition to the rearwardly facing surface of the face panel and the support surface of the shoulder;

(c) a portion of the tension member extending around the securing block so as to be disposed between the block, the rearwardly facing surface of the face panel, and the support surface of the shoulder and, (d) a pin extending into aligned openings in the lower leg and the securing block to maintain the securing block in aligned condition on the lower leg.

2. An apparatus according to claim 1 wherein the lower leg of the L-shaped block includes a turned-up distal edge spaced from the upright leg to define therewith a channel proportioned for receipt of the securing block.

3. An improved apparatus for securing a soil reinforcing mat having a longitudinal tension member to a face panel for an earthen formation, said apparatus comprising:

(a) an upwardly facing shoulder extending from a rearwardly facing surface of the face panel, said shoulder having a support surface;

(b) a securing block separate from and extending transversely of the face panel, said block being supported on the shoulder and having surfaces disposed in apposition to the rearwardly facing surface of the face panel and the support surface of the shoulder;

(c) a portion of the tension member extending around the securing block so as to be disposed between the block, the rearwardly facing surface of the face panel, and the support surface of the shoulder; and, (d) a downwardly facing shoulder extending rearwardly from the face panel in spaced relationship to the upwardly facing shoulder, said downwardly facing shoulder having an undersurface disposed above and in apposition to the securing block.

4. An apparatus according to claim 2 wherein the face panel corpises a lower block which provides the upwardly facing shoulder, and intermediate block supported on the lower block which provides the rearwardly facing surface, and an upper block supported on the intermediate block which provides the downwardly facing shoulder.

5. An apparatus according to claim 3 wherein the face panel comprises:

a) a first integral L-shaped block having a lower leg which provides the upwardly facing shoulder and an upright leg which provides the rearwardly facing surface; and, b) a second integral L-shaped block stacked upon the first L-shaped block, said second block having a lower leg supported on the upright leg of the first block to provide the downwardly facing shoulder.

6. An apparatus according to claim 3 wherein a portion of the tension member extends around the securing block so as to be disposed between the securing block and the undersurface of the downwardly facing shoulder.

7. An apparatus for securing a longitudinal tension member of a geotextile soil reinforcing mat to a panel disposed at the face of an earthen formation, said apparatus comprising:

a) an anchor element fixed to and extending rearwardly from the panel;

b) a securing block separate from and extending transversely of the panel, said block being held to the anchor element and having a surface disposed in apposition to the rearwardly facing surface of the panel; and, c) a portion of the tension member extending around the securing block so as to be held between the block and the rearwardly facing surface of the panel.

8. An apparatus according to claim 7 wherein:

(a) the anchor element comprises an upwardly facing shoulder extending rearwardly from the panel, said shoulder having a support surface; and, (b) the securing block is supported on the support surface of the shoulder whereby the tension member is held between the block and shoulder.

9. An improved combination for constructing a soil reinforced retaining wall having a cast in place face surface, said combination comprising:

a) alternate courses of concrete blocks comprised of integral front and rear portions with the front portions being of an open bifurcated configuration;

b) intermediate courses of concrete blocks disposed between the alternate courses of blocks, said intermediate courses being comprised of front portions of an open bifurcated configuration and rear portions separable from the front portions; and, c) soil reinforcing tension members extending around at least some of the rear portions of the intermediate courses so as to be disposed between the rear portions of the alternate courses.

10. An improved soil reinforced retaining wall having a cast in place face surface, said wall comprising:

a) a foundation footer having rebars extending upwardly therefrom;

b) alternate courses of concrete blocks supported on and above said footer and comprised of integral front and rear portions with the front portions being of an open bifurcated configuration having the rebars extending therethrough;

c) intermediate courses of concrete blocks disposed between the alternate courses of blocks, said intermediate courses being comprised of front portions of an open bifurcated configuration having the rebars extending therethrough and rear portions separable from the front portions;

d) soil reinforcing tension members extending around at least some of the rear portions of the intermediate courses so as to be disposed between the rear portions of the alternate courses; and, e) a concrete face cast in place over and within the front portions of the alternate and intermediate courses of blocks and around the rebars extending therethrough.

11. A fortress comprising:

(a) alternate courses of concrete blocks comprised of integral front and rear portions;

(b) intermediate courses of concrete blocks disposed between the alternate courses of blocks, said intermediate courses being comprised of front portions disposed between the front portions of the blocks of the alternate courses and rear portions separable from the front portions thereof disposed between the rear portions of the blocks of the alternate courses; and, (c) soil reinforcing tension members extending around at least some of the rear portions of the blocks of the intermediate courses so as to be captured between front and rear portions of blocks in certain of the intermediate courses and the rear portions of the blocks in alternate courses to either side thereof.

12. A fortress comprising:

(a) spaced walls each comprising:

(1) alternate courses of concrete blocks comprised of integral front and rear portions; and, (2) intermediate courses of concrete blocks disposed between the alternate courses of blocks, said intermediate courses being comprised of front portions disposed between the front portions of the blocks of the alternate courses and rear portions separable from the front portions thereof disposed between the rear portions of the blocks of the alternate courses;

(b) soil reinforcing tension members extending between the spaced walls to tie the walls together said tension members being connected to the walls by extending the members around at least some of the rear portions of the blocks of the intermediate courses in the walls so as to capture the members between front and rear portions of blocks in certain of the intermediate courses and the rear portions of the blocks in alternate courses to either side thereof; and, (c) fill contained between the spaced walls and around the soil reinforcing tension members.

13. A method of constructing a soil reinforced earthen retaining wall, said method comprising:

(a) providing alternate courses of concrete blocks comprised of integral front and rear portions;

(b) providing intermediate courses of concrete blocks disposed between the alternate courses of blocks, said intermediate courses being comprised of front portions disposed between the front portions of the blocks of the alternate courses and rear portions separable from the front portions thereof disposed between the rear portions of the blocks of the alternate courses;

(c) extending soil reinforcing tension members around at least some of the rear portions of the blocks of the intermediate courses so as to capture the members between front and rear portions of the blocks in certain of the intermediate courses and the rear portions of the blocks in alternate courses to either side thereof; and, (d) backfilling soil around the soil reinforcing tension members.

14. A method of constructing an earthen fortress comprising:

(a) providing spaced walls each comprising:

(1) alternate courses of concrete blocks comprised of integral front and rear portions; and, (2) intermediate courses of concrete blocks disposed between the alternate courses of blocks, said intermediate courses being comprised of front portions disposed between the front portions of the blocks of the alternate courses and rear portions separable from the front portions thereof disposed between the rear portions of the blocks of the alternate courses;

(b) tying the spaced walls together by extending soil reinforcing tension members therebetween, said tension members being connected to the walls by extending the members around at least some of the rear portions of the blocks of the intermediate courses in the walls so as to capture the members between front and rear portions of the blocks in certain of the intermediate courses and rear portions of the blocks in alternate courses to either said thereof; and, (c) filling soil between the spaced walls and around the soil reinforcing tension members.

15. A method of constructing a soil reinforced retaining wall having a cast in place face surface, said method comprising:

a) providing a foundation footer having rebars extending upwardly therefrom;

b) supporting alternate courses of concrete blocks on and above said footer, said alternate courses being comprised of integral front and rear portions with the front portions being of an open bifurcated configuration having the rebars extending therethrough;

c) disposing intermediate courses of concrete blocks between the alternate courses of blocks, said intermediate courses being comprised of front portions of an open bifurcated configuration having the rebars extending therethrough and rear portions separable from the front portions;

d) extending soil reinforcing tension members around at least some of the rear portions of the intermediate courses; and, e) casting a concrete face in place over and within the front portions of the alternate and intermediate courses of blocks and around the rebars extending therethrough.

16. A soil reinforced structure comprising:

(a) superimposed courses of concrete blocks, at least some of which are of an L-shaped cross section having lower legs and have rearward portions separable therefrom resting on the lower legs;

(b) longitudinally extending soil reinforcing members extending around the separable rearward portions between the courses of blocks thereabove and therebelow;

(c) soil backfilled around the soil reinforcing members; and, (d) pins extending into aligned openings in the lower legs and the separable rearward portions resting thereon to maintain the separable rearward portions in aligned condition on the lower legs.

17. A structure according to claim 16 wherein the lower legs of successive courses of blocks define therebetween a space for receipt of the separable rearward portions.

18. A structure according to claim 16 further comprising turned-up distal edges on the lower legs to define channels for receipt of the separable rearward portions.

* * * * *